United States Patent [19]

Carlstedt

[11] Patent Number: 4,556,149

[45] Date of Patent: Dec. 3, 1985

[54] DRAFT GEAR

[75] Inventor: Richard A. Carlstedt, Wheaton, Ill.

[73] Assignee: Miner Enterprises, Geneva, Ill.

[21] Appl. No.: 494,428

[22] Filed: May 13, 1983

[51] Int. Cl.[4] ..... B61G 9/10; B61G 11/14

[52] U.S. Cl. ..... 213/34; 213/32 A; 213/37

[58] Field of Search ..... 213/31, 32 R, 32 A, 213/34, 36, 37

[56] References Cited

U.S. PATENT DOCUMENTS

| | | | |
|---|---|---|---|
| 1,695,500 | 12/1928 | O'Connor | 213/31 |
| 1,974,596 | 9/1934 | Barrows | 213/36 X |
| 2,307,236 | 1/1943 | Pierce | 213/32 R |
| 2,572,453 | 10/1951 | Dentler | 213/31 |
| 2,588,703 | 3/1952 | Cottrell | 213/34 |
| 3,386,597 | 6/1968 | Willison et al. | 213/37 X |

*Primary Examiner*—Robert B. Reeves
*Assistant Examiner*—David F. Hubbuch
*Attorney, Agent, or Firm*—Wood, Dalton, Phillips, Mason & Rowe

[57] ABSTRACT

An improved draft gear for transmitting draft forces in railway vehicles. The invention includes a housing with a closed end and an open opposite end provided with a tapered internal friction surface. A wedge is mounted for axial movement in the open end of the housing and friction shoes are positioned within the housing between the wedge and adjacent portions of the internal friction surface. A follower member is positioned adjacent the friction shoes and springs are positioned between the closed end of the housing and the follower member to urge the follower member against the shoes. Each of the shoes has a beveled outer surface in engagement with a beveled inner surface of the wedge, the beveled inner and outer surfaces being formed at a first selected angle with respect to the axis of the housing. Each of the shoes also has a beveled inner face in engagement with a beveled outer face of the follower member, the beveled inner and outer faces being formed at a second selected angle with respect to the axis of the housing. The angle of the bevel on the outer faces of the follower thereby assists in the assembly of the draft gear. The surface area of each of the inner faces is at least equal to the surface area of the engaged outer face of the follower member such that during application of force to the draft gear, the inner face traverses the entire surface of the outer face to prevent accumulation of metal at the interface of the inner and outer faces.

7 Claims, 8 Drawing Figures

10
12
14
16
18
20
22
24
26
28
30
32
34
36
38
40
42
46
48
50
52
54
60
5.
6.

DRAFT GEAR

BACKGROUND OF THE INVENTION

The present invention relates to draft gears and, in particular, to an improved friction draft gear having superior means of dissipating and absorbing draft forces.

In prior art draft gears, as exemplified by U.S. Pat. No. 3,227,288, which is assigned to the assignee of the present invention, draft forces impinging upon a wedge extending from the draft gear are dissipated in the housing of the draft gear through a series of friction shoes. The end of the draft gear housing in which the wedge and shoes are located has an inwardly tapered friction surface such that as the wedge is forced into the interior of the housing, frictional force increases between the shoes and the housing. The shoes in turn abut a generally circular follower member or plate which is forced against the shoes by resilient means such as a stack of cushioning pads. As shown in U.S. Pat. Nos. 2,139,701 and 2,159,457, a series of concentric springs can be used in place of the cushioning pads.

While the draft gear of U.S. Pat. No. 3,227,228 has a high shockabsorbing capacity, a problem has occurred at the interface of the shoes with the follower plate. Since the shoes travel both axially and radially inwardly during absorption of draft forces, over time the shoes tend to gall the metal and carve paths into the abutting face of the follower plate. This creates an accumulation of metal at the edges of the shoe contact pattern, preventing greater travel of the shoes along the follower plate. If larger draft forces than normal are experienced by the draft gear, often the accumulated material prevents required travel of the shoe, creating substantial stresses which result in erratic operation and, at times, cause the shoes to break within the draft gear. The draft gear then must be either replaced or rebuilt. The prior design for the shoes, wedge and follower also created some difficulties in maintaining the components of the draft gear in position during assembly.

SUMMARY OF THE INVENTION

The present invention overcomes the disabilities of the prior art by providing a friction draft gear which does not permit the accumulation of metal on either the shoes or the follower plate and which facilitates assembly. In accordance with conventional friction draft gears, the present invention includes a housing with a closed end and an open opposite end which is provided with a tapered internal friction surface. Wedge means is mounted for axial movement in the open end of the housing and is situated for direct application of draft forces. Friction means is positioned within the housing between the wedge means and the friction surface and is engageable with the wedge means and the friction surface to absorb the shock created by the application of a draft force to the wedge. As also conventional, the present invention includes a follower member positioned adjacent the friction means and resilient means positioned between the closed end of the housing and the follower member to cause the follower member to urge the friction means into engagement with the wedge means and the friction surface.

In accordance with this invention, the improved friction means includes a series of annularly spaced friction shoe means each having a flat, beveled outer surface in engagement with a flat, beveled inner surface of the wedge means. The beveled inner and outer surfaces are formed at a first selected angle with respect to the axis of the housing. Each of the shoes also has a flat, beveled inner face in engagement with a flat, beveled outer face formed in the follower member, the beveled inner and outer faces being formed at a second selected angle with respect to the axis of the housing. To prevent material accumulation, the surface area of each of the inner faces on the shoe means is at least equal to the surface area of the engaged outer face on the follower member so that during application of force to the draft gear, each inner face traverses the entire surface of its associated outer face on the follower member to prevent accumulation of metal at the interface of the inner and outer faces.

In the preferred embodiment of the invention, the surface area of the beveled outer surfaces of each of the shoe means is at least equal to the surface area of the engaged inner surface of the wedge means such that during application of force to the draft gear, the outer surface traverses the entire surface of the inner surface to prevent accumulation of material at the interface of these two surfaces. The angle of the faces on the follower members also urge the associated friction shoe outwardly toward the housing. The shoes and wedge are thereby maintained in the proper position in the housing during assembly.

In the illustrated embodiment of the invention, the second selected angle of the adjoining faces of the shoe means and follower member is approximately 60°. The first selected angle of the adjoining surfaces of the shoe means and the wedge is approximately 45°. The resilient means can comprise a plurality of concentric springs, a series of stacked resilient pads, or any other resilient mean for urging the follower member into engagement with the shoe means while at the same time absorbing some shock forces. If the resilient means comprises a plurality of concentric springs, the follower member also may include a boss in alignment with the centermost of the concentric springs to guide location of the springs with respect to the follower member.

In the preferred embodiment of the invention, three shoe means are annularly spaced in the open end of the housing of the draft gear. Therefore, there are three of the inner faces (one on each shoe) and three of the corresponding outer faces formed in the follower member. There also are three of the outer surfaces (one on each shoe means) and three of the inner surfaces formed in the wedge means. Such an arrangement provides the draft gear with dynamic and static stability.

In order to diminish the weight of the draft gear, the follower member includes a recess channel between adjacent faces and a central recess, thus forming each of the outer faces as a raised pad on the follower member.

BRIEF DESCRIPTION OF THE DRAWINGS

Other features and advantages of the invention will become apparent in the following description of the preferred embodiment, taken in conjunction with the drawings, in which.

DESCRIPTION OF THE PREFERRED EMBODIMENT

Figure 1:
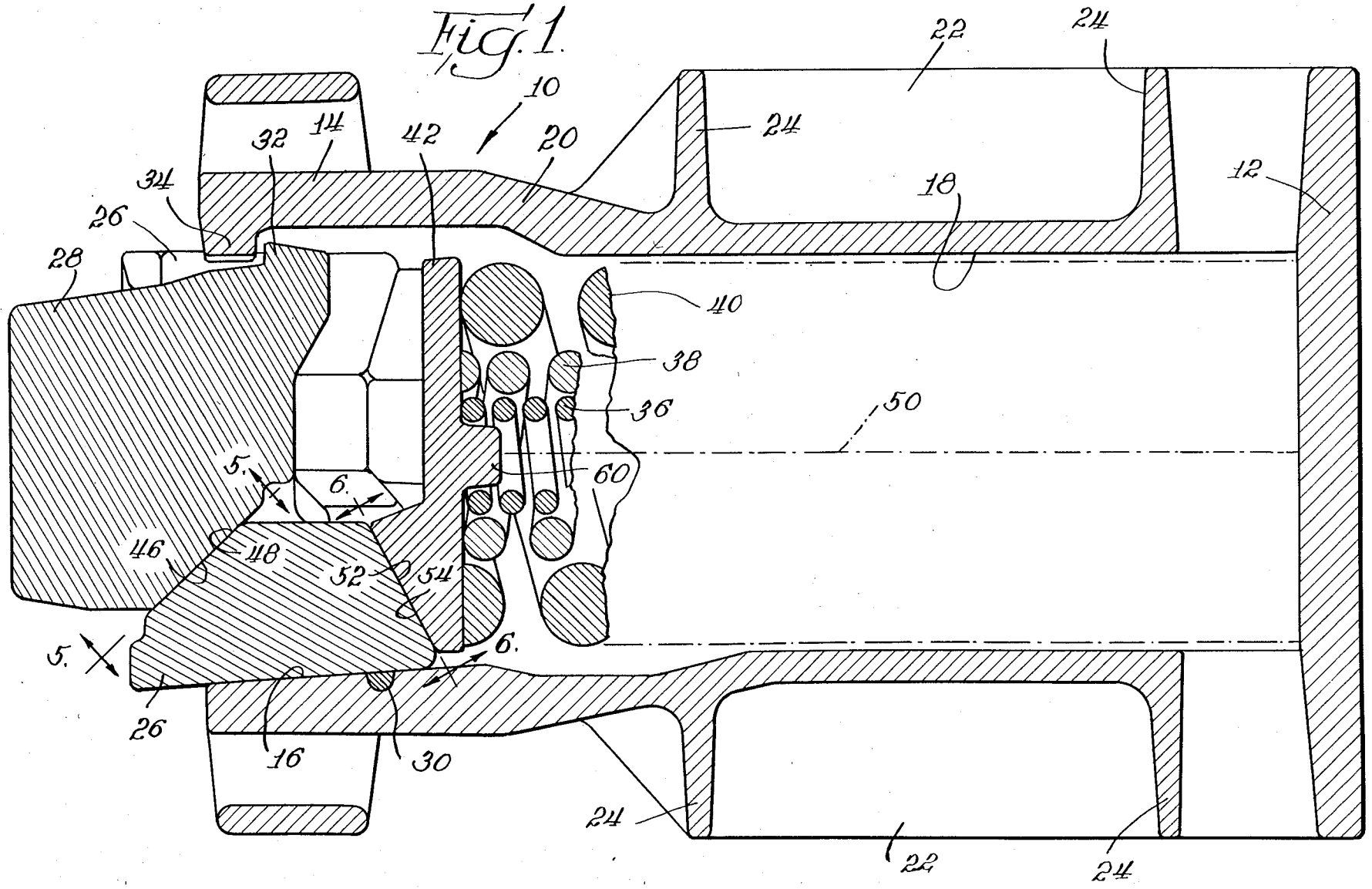
FIG. 1 is a longitudinal cross-sectional illustration of a draft gear according to the invention.
Figure 2:
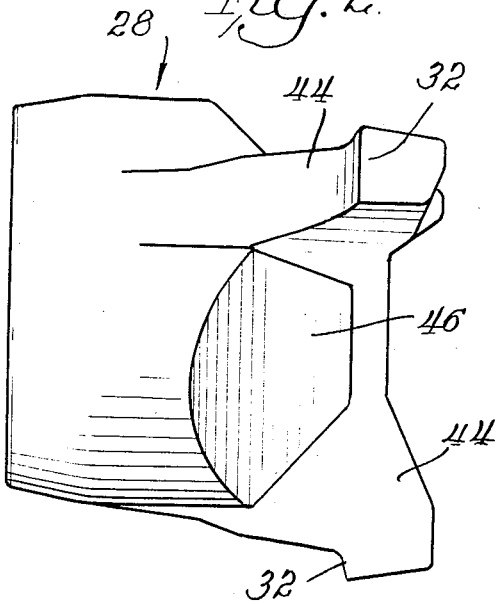
FIG. 2 is a side elevational illustration of the wedge for the draft gear of FIG. 1.
Figure 3:
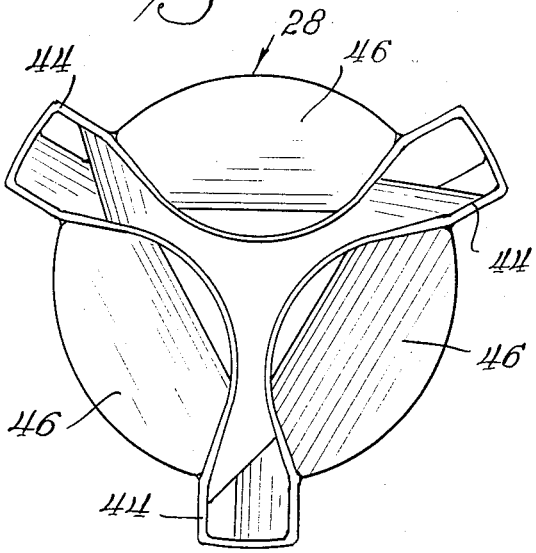
FIG. 3 is an inside elevational illustration of the wedge of FIG. 2, viewed from the right of FIG. 2.
Figure 5:
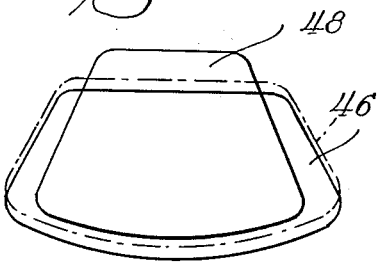
Figure 4:
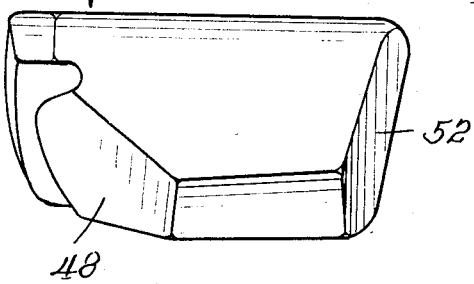
FIG. 4 is a side elevational illustration of one of the shoe means included in the draft gear of FIG. 1, FIG. 5 schematically illustrates the abutment of the surfaces of one of the shoe means and the wedge of the draft gear of FIG. 1, as shown at line 5—5 of FIG. 1, FIG. 6 schematically illustrates the abutment of the faces of one of the shoe means and the follower member of the draft gear of FIG. 1, as shown at line 6—6 of FIG. 1.
Figure 6:
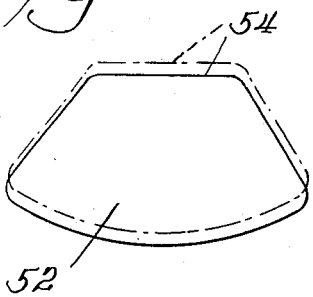

As illustrated in the drawings, a friction draft gear according to the invention includes an axially bored housing or casing 10 with one end thereof being closed by a fixed enlarged rectangular end wall or plate 12. The length of the housing 10 may vary in accordance with the length of the sill pocket of the railway vehicle in which the same is to be mounted. The housing 10 is provided adjacent its open end with a thick-walled friction shell section 14 having three tapered internal friction surfaces 16 converging toward the closed end of the housing 10. Spaced inwardly of the shell section 14, the housing 10 is provided with an internal bore 18 which terminates at the end wall 12 and which is characterized by a thinner wall section and by a generally cylindrical inner configuration. The shell section 14 and the bore 18 are integrally interconnected by a transition wall section 20 which serves to blend the configuration of the shell section 14 and the bore 18 into each other both internally and externally. Suitable integral external supporting rib structures 22 are provided on opposite sides of the housing 10 between the transition wall section 20 and the end wall 12. Annular supporting rib structures 24 may also be employed to strengthen the housing 10.

As is conventional, a series of three friction shoes 26 are circumferentially spaced in the shell section 14 in sliding friction-producing engagement with an associated internal friction surface 16 of the shell section 14. The shoes 26, when assembled as shown, define an outwardly opening pocket for receiving the inner end of a wedge 28.

In addition to the resistance developed in the shell section 14 during inward movement of the frictions shoes 26 and the wedge 28, a resilient material may be provided in the inner end of the housing 10. Such resilient means maintains the wedge and shoes in operative engagement with each other and with the housing during the operation of the draft gear. The resilient means also resists inner movement of the shoes 26 to aid in cushioning draft forces applied to the draft gear. As shown in FIG. 1, the friction surfaces 16 may be provided with a circumferentially extending groove filled with a bronze insert 30 or other suitable material.

To retain the wedge 28 and the shoes 26 in the open end of the housing 10, the inner edge of the wedge 28 is provided with a series of circumferentially spaced outwardly projecting flanges 32 and the housing 10 is provided with a corresponding number of spaced, inwardly projecting lugs 34 at its open end. During assembly of the draft gear, the flanges 32 are engaged behind or inwardly of the lugs 34 so that the wedge 28 and shoes 26 are positively retained in assembled relationship in the housing 10.

A resilient means in the form of a series of concentric springs 36, 38 and 40 is seated against the inner face of the end wall 12. Alternatively and in place of the springs 36 through 40, a plurality of stacked cushioning units in accordance with U.S. Pat. No. 3,227,288 may be employed, or other suitable resilient means can be used. A generally circular follower plate or member 42 is disposed between the outer ends of the springs 36 through 40 and the inner ends of the friction shoes 26 and is adapted for longitudinal movement in the housing 10 to compress the springs 36 through 40 when draft forces are applied to the wedge 28. The springs 36 through 40 are preferrably precompressed when the springs 36 through 40, follower member 42, friction shoes 26 and wedge 28 are assembled in the housing 10.

The wedge 28, an individual friction shoe 26 and the follower member 42 are best shown in FIGS. 2 through 8. The wedge 28 includes three equally spaced projecting dividers 44 in which the flanges 32 are formed. A flat, beveled inner surface 46 is formed in the wedge 28 between each of the dividers 44. Each friction shoe 26 includes a corresponding beveled outer surface 48 in engagement with a corresponding one of the beveled inner surfaces 46. As best shown in FIG. 1, the bevels of the surfaces 46 and 48 are equal and are at approximately 45° with respect to the central axis 50 of the housing 10.

Each friction shoe 26 also has a beveled inner face 52 which is in engagement with a corresponding outer face 54 of the follower member 42. As best shown in FIG. 1, the beveled inner and outer faces are formed at a second angle with respect to the axis 50 of the housing 10. In the illustrated embodiment of the invention, this angle is approximately 62°.

Figure 7:
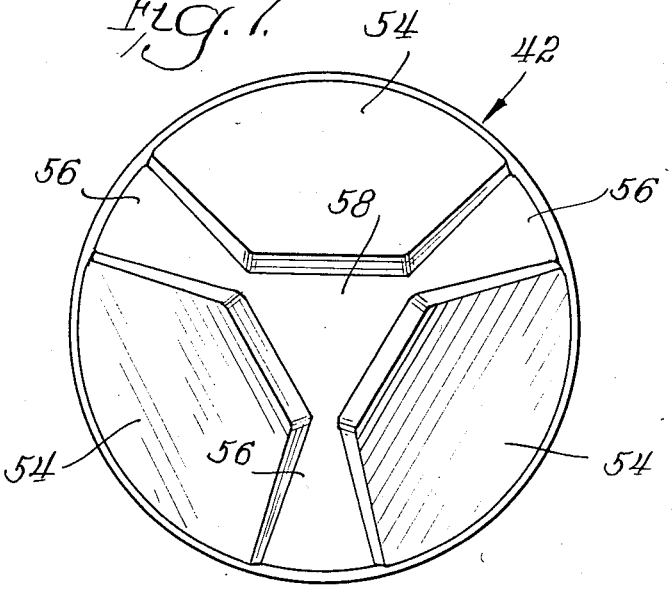
FIG. 7 is an outer end elevational illustration of the follower member of the draft gear of FIG. 1.
Figure 8:
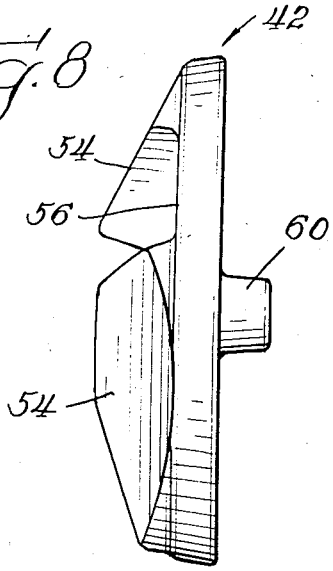
FIG. 8 is a side elevational illustration of the follower member of FIG. 7.

As seen in FIGS. 7 and 8, the side of the follower member 42 carrying the outer faces 54 includes a recessed channel 56 between adjacent outer faces 54, and also a central recess 58. The channels 56 and central recess 58 reduce the weight of the follower 42 and define each of the outer faces as a raised pad on the follower member 42. The other side of the follower plate 42 includes a central raised boss 60. The boss 60, as shown in FIG. 1, is in alignment with the center-most spring 36 to guide the location of the springs 36 through 40 with respect to the follower member 42.

FIG. 1 illustrates the components of the invention in essentially a rest position with little or no draft force applied to the wedge 28. When draft force is applied to the wedge 28, the wedge 28 through the interface of its surfaces 46 and the surfaces 48 of the friction shoes 26, forces the friction shoes 26 against the internal friction surfaces 16. At the same time, the springs 36 through 40 urge the follower member 42 against the inner ends of the friction shoes 26, thereby assuring that the shoes are in forceful frictional contact with the internal friction surface 16. As the wedge 28 is forced into the housing 10, the shoes 26 are translated both axially inwardly and radially inwardly, due to the inwardly tapered slope of the friction surfaces 16. The follower member 42 is displaced axially inwardly against the springs 36 through 40 by the shoes 26. Initially, and as shown in FIG. 1, each of the surfaces 52 overhangs the outer edge of the surfaces 54. At full travel within the housing 10, the shoes 26 will have moved radially inwardly (toward the axis 50) to a position where each of the surfaces 52 will have traversed the surface 54 to a position where the surfaces 52 overhang the inner edges of the surfaces 54. This results in a "wiping" type of action and prevents accumulation of material at the interface of the faces 52 and 54.

With the faces 52 of the friction shoes 26 being at least as large as the faces 54 of the follower member 42, the friction shoes 26 "wipe" the mating surfaces of the follower member 42. This reduces the tendancy of metal to accumulate at the edges of the shoe contact pattern.

Because of the beveled contact between the shoes 26 and the follower member 42, the shoes 26 are constantly biased against the friction surfaces 16. This reduces the recoil of the draft gear following application of draft force to the wedge 28. The beveled contact also causes additional travel of the follower member 42 as opposed to a conventional follower member, such as that shown in U.S. Pat. No. 3,227,288. The springs 36 through 40 are therefore further compressed, utilizing additional spring energy.

Since the shoes 26 are biased radially outwardly toward the internal friction surfaces 16 at all times, the follower member 42 tends to stabilize the friction shoes 26 during assembly of the draft gear. Therefore, additional constraints against movement of the shoes 26 during assembly are not required, as in the prior art.

The flat, beveled surfaces 46 and 48 and faces 52 and 54 therefore provide greater dissipation of frictional energy, prevent accumulation of metal across the shoe contact pattern, permit elimination of excessive material to reduce the weight of the draft gear, and preclude the need of additional constraints for assembly of the draft gear.

Various changes can be made to the invention without departing from the spirit of the invention or the scope of the following claims.

What is claimed is:

1. In a friction draft gear having a housing with a closed end and an open opposite end on an axis therebetween, said open opposite end being provided with an inwardly tapered internal friction surface, wedge means mounted for axial movement in the open end of said housing and against which a draft force can be applied, friction means positioned within said housing between said wedge means and said friction surface and engageable with said wedge means and said friction surface to absorb the shock created by the application of a draft force to said wedge means, a follower member positioned adjacent said friction means, and resilient means positioned between the closed end of the housing and said follower member to cause said follower member to urge said friction means into engagement with said wedge means and said friction surface, the improvement comprising:

a. said friction means including a series of annularly spaced friction shoe means each having a beveled outer surface in engagement with a beveled inner surface of said wedge means, said beveled inner and outer surfaces being formed at a first selected angle with respect to the axis of said housing, b. said shoe means each having a beveled inner face in engagement with a beveled outer face of said follower member to urge said shoe means into forceful frictional contact with said internal friction surface, said beveled inner and outer faces being formed at a second selected angle with respect to the axis of said housing, c. each said outer face being formed by recess means thereabout to form a respective raised pad, the surface area of each said inner face being at least equal to the surface area of the engaged raised pad and the surface area of the raised pad being sufficiently large such that during application of force to the draft gear each said inner face traverses substantially the entire surface of said respective raised pad and each raised pad traverses substantially the entire surface of the respective inner face to prevent accumulation of material at the interface of said inner and outer faces.

2. A friction draft gear according to claim 1 in which said second selected angle is an outwardly converging angle of approximately 60° with respect to the axis of said housing.

3. A friction draft gear according to claim 2 in which said first selected angle is an inwardly converging angle of approximately 45° with respect to the axis of said housing.

4. A friction draft gear according to claim 1 in which said resilient means comprises a plurality of concentric springs.

5. A friction draft gear according to claim 4 including a boss on said follower member in alignment with the center-most of said concentric springs to guide location of said springs with respect to said follower member.

6. A friction draft gear according to claim 1 including three equally spaced shoe means, three of said inner faces provided on said shoe means and three of said outer faces provided on said follower.

7. A friction draft gear according to claim 1 in which said recess means comprises a recessed channel between adjacent outer faces and a central recess, thus forming each said outer face as said raised pad on said follower member.

* * * * *